US009326650B2

(12) United States Patent
Wisdom

(10) Patent No.: US 9,326,650 B2
(45) Date of Patent: May 3, 2016

(54) TOILET WITH STORAGE COMPARTMENT

(71) Applicant: Kharey Wisdom, Wesley Chapel, FL (US)

(72) Inventor: Kharey Wisdom, Wesley Chapel, FL (US)

( * ) Notice: Subject to any disclaimer, the term of this patent is extended or adjusted under 35 U.S.C. 154(b) by 443 days.

(21) Appl. No.: 14/045,082

(22) Filed: Oct. 3, 2013

(65) Prior Publication Data

US 2015/0096114 A1 Apr. 9, 2015

(51) Int. Cl.

| | |
|---|---|
| ***E03D 11/13*** | (2006.01) |
| ***A47K 17/02*** | (2006.01) |
| ***E03D 9/06*** | (2006.01) |
| ***E03D 11/00*** | (2006.01) |

(52) U.S. Cl.

CPC . *A47K 17/02* (2013.01); *E03D 9/06* (2013.01); *E03D 11/00* (2013.01)

(58) Field of Classification Search

CPC ..... A47K 10/22; A47K 17/00; A47K 17/02; E03D 9/00; E03D 11/13; E03D 9/06; E03D 11/00

USPC ..... 4/300.1, 420

See application file for complete search history.

(56) References Cited

U.S. PATENT DOCUMENTS

| | | | | | |
|---|---|---|---|---|---|
| 1,607,302 | A * | 11/1926 | Pentecost | A47K 10/38 | 242/598.6 |
| 2,022,265 | A * | 11/1935 | Williams | E03D 9/06 | 248/161 |
| 2,661,481 | A * | 12/1953 | Goodfield | A47K 17/00 | 312/237 |
| 2,749,968 | A * | 6/1956 | Suser | A47K 13/00 | 312/228 |
| 3,905,051 | A * | 9/1975 | Gozdziewski | A47C 15/004 | 297/188.14 |
| 4,008,933 | A * | 2/1977 | Wanek | A47K 10/22 | 312/206 |

* cited by examiner

*Primary Examiner* — J. Casimer Jacyna

(74) *Attorney, Agent, or Firm* — Gulf Coast Intellectual Property Group

(57) ABSTRACT

A toilet having a base wherein the base is configured with an integrated storage compartment. The integrated storage compartment is secured to the base using suitable techniques and includes a rear wall, bottom and outer wall configured to define an interior volume. The outer wall is hingedly secured to the bottom and is operable to transition to a second open position providing access to the interior volume. A plurality of shelves and/or storage containers are disposed within the interior volume operable to receive and store items therein. The outer wall is formed so as to mateably align with at least a portion of the bowl so as to create a seamless appearance therewith. The rear wall of the storage compartment further includes a protruded portion operable to mate with a plumbing recess on the base of the toilet.

10 Claims, 3 Drawing Sheets

TOILET WITH STORAGE COMPARTMENT

FIELD OF THE INVENTION

The present invention relates generally to toilets, more specifically but not by way of limitation a toilet wherein the base of the toilet further includes an integral storage compartment operable to provide storage for a plurality of objects.

BACKGROUND

Conventional toilet design has remained the same for decades. As is known in the art toilets have a base with an integrated bowl having an opening with a hingedly attached lid and seat. A tank is operably secured to the base and provides the water necessary to operate the toilet. The conventional design of the toilet base includes a bottom portion that is generally perpendicular to the floor that is integrally formed with the bowl in the front area and tapers to a more narrow width proximate the rear end in the area generally underneath the tank.

One problem with conventional toilet design is their fairly large footprint. In homes with small bathrooms it is a challenge to maximize the available storage space subsequent the installation of a toilet and a small vanity. Smaller bathrooms often lack suitable storage areas for items such as but not limited to personal hygiene and other toiletries. Currently, individuals will use shelving or racks placed above the toilet tank or on the bathroom walls in an effort to create storage space for items. While these storage shelves and racks provide additional space, the storage they offer is generally limited. Additionally, utilization of shelves and/or racks does not provide concealed storage for items that an individual may not want to be displayed on a rack or shelf.

Another issue with conventional toilet design is the lack of maximizing available space in the base of the toilet. Conventional toilet bases have a consistent footprint in terms of width proximate the front end and rear end of the base but the design of the base proximate the rear end that contains the plumbing is significantly more narrow in width than the bowl and the edge superposed the floor. Utilization of this space to form an integrated storage compartment would provide concealed storage for personal hygiene items that are often applied during use of a toilet as well as provide additional storage space for smaller bathrooms.

Accordingly there is a need for a toilet having a base that includes an integral storage compartment proximate the rear end behind the bowl and underneath the tank wherein the base can include the integral storage compartments on the left side and/or the right side of the toilet base.

SUMMARY OF THE INVENTION

It is the object of the present invention to provide a toilet having a base wherein the base includes an integral storage compartment operable to provide storage for a plurality of items.

Another object of the present invention is to provide a toilet having a base with an integral storage compartment wherein the storage compartment has a door design that is formed to integrally align with at least a portion of the bowl.

Yet a further object of the present invention is to provide a toilet having a base with integral storage wherein the interior of the storage compartment is configured with adjustable storage shelves and/or containers so as to accommodate different sized items.

Still another object of the present invention is to provide a toilet having a base with an integral storage compartment wherein the storage compartment access door is hingedly attached to provide access to the interior volume of the storage compartment.

An additional object of the present invention is to provide a toilet having a base with an integral storage compartment wherein the storage compartment is designed to be releasably secured to the toilet base.

A further object of the present invention is to provide a toilet having a base with an integral storage compartment wherein the storage compartment includes a rear wall that is manufactured from a formable material.

To the accomplishment of the above and related objects the present invention may be embodied in the form illustrated in the accompanying drawings. Attention is called to the fact that the drawings are illustrative only. Variations are contemplated as being a part of the present invention.

BRIEF DESCRIPTION OF THE DRAWINGS

A more complete understanding of the present invention may be had by reference to the following Detailed Description when taken in conjunction with the accompanying Drawings wherein the drawings provide schematic views of a preferred embodiment of the present invention only and do not serve to limit the scope of the present invention.

DETAILED DESCRIPTION

Figure 1:
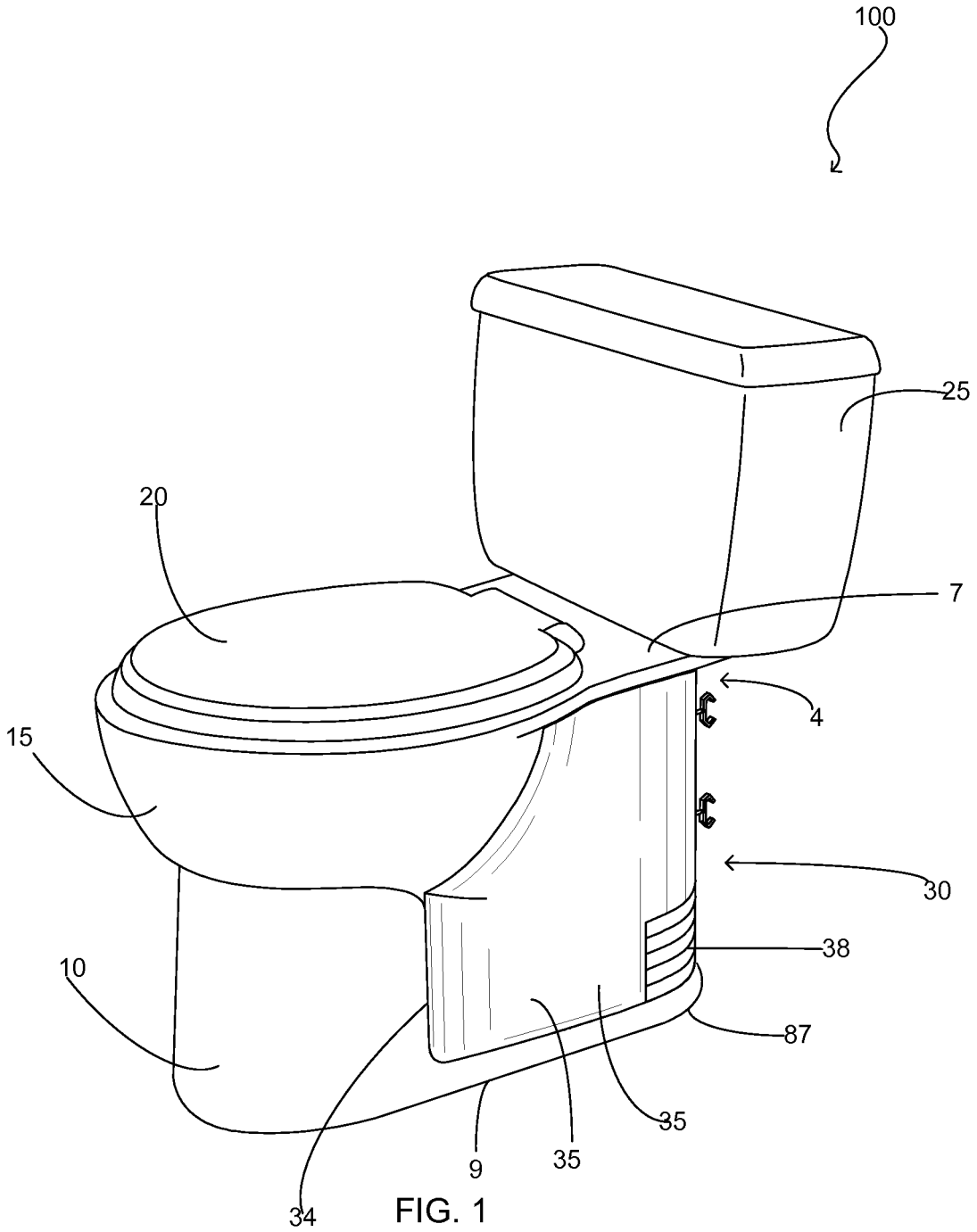
FIG. 1 is a perspective view of the present invention with the storage compartment door in a closed position.

Referring now to the drawings submitted herewith, wherein various elements depicted therein are not necessarily drawn to scale and wherein through the views and figures like elements are referenced with identical reference numerals, there is illustrated a toilet with integrated storage 100 constructed according to the principles of the present invention.

The toilet with integrated storage 100 includes a base 10 having an integrated bowl 15 with hingedly attached lid 20. A tank 25 is operably coupled to the rear end 11 of the base 10. The base 10, bowl 15 and tank 25 are manufactured from a suitable durable material such as but not limited to porcelain and these elements of the toilet with integrated storage 100 are manufactured similar to conventional toilets.

Figure 2:
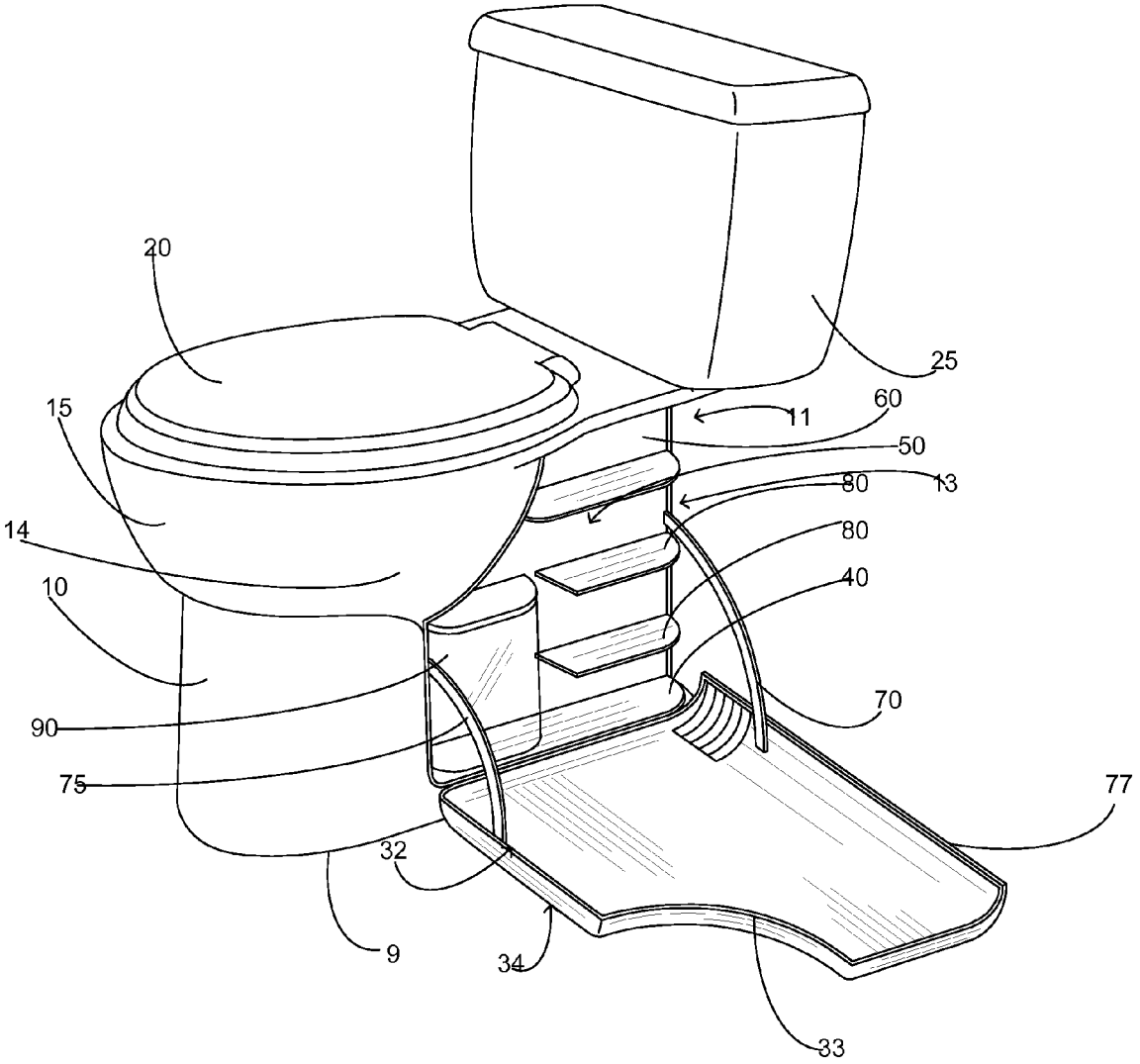
FIG. 2 is a perspective view of the present invention with the storage compartment door in an open position.

Integrally constructed into the rear side area 13 of the base 10 is a storage compartment 30. The storage compartment 30 includes an outer wall 35 that is hingedly attached to the base 10. As shown in FIG. 2, the outer wall 35 is hingedly secured to the bottom 40 of the storage compartment 30 utilizing suitable durable fasteners. The hinged securing of the outer wall 35 facilitates the opening of the storage compartment 30 such that the outer wall 30 transitions away from the base 10 as it is moved towards its second position allowing access to the interior volume 50 thereof. The outer wall 35 further includes a curved portion 77 that is operably to be of similar shape as the end 87 of the base 10. This design further enhances the desired seamless appearance of the storage compartment 30. While in the preferred embodiment the outer wall 35 is hingedly attached to the bottom 40, it is further contemplated within the scope of the present invention that the outer wall 35 could be hingedly attached along the rear edge 36 facilitating the outer wall 35 to be opened such that the front edge 34 would swing away from the base 10 as the outer wall 35 is being transitioned to its second position allowing access to the interior volume 50.

The outer wall 35 is constructed from a suitable durable material such as but not limited to plastic. The outer wall 35 includes front edge 34 having a lower portion 32 and an upper portion 33. The lower portion 32 is generally perpendicular the to bottom edge 9 of the base 10. The upper portion 33 of the front edge 34 is arcuate in manner having a similar radius to the exterior surface 14 of the bowl 15. The lower portion 33 and upper portion 34 are formed so as to be substantially flush in appearance with the base 10 and bowl 15. The exterior surface 37 of the outer wall 35 does not extend beyond the bottom edge 9 of the base 10 and is designed so as to not extend outward from the upper portion 7 of the base 10 proximate the top area 4. This design for the outer wall 35 creates a desirable appearance and is further operable not to impact the footprint of the base 10 so as to avoid impact on installation of the toilet with integrated storage 100 in small areas. The outer wall 35 further includes a plurality of vents 38. The vents 38 are integrally formed into the outer wall 35 and are operable to allow air into the interior volume 50 of the storage compartment 30. The vents 38 facilitate airflow into the interior volume 50 further controlling the humidity therein. This reduces the potential accumulation of mold and similar substances. Those skilled in the art will recognize that the outer wall 35 could have more the one vent 38 integrally formed therein and could further be located in numerous locations on the outer wall 35.

Figure 3:
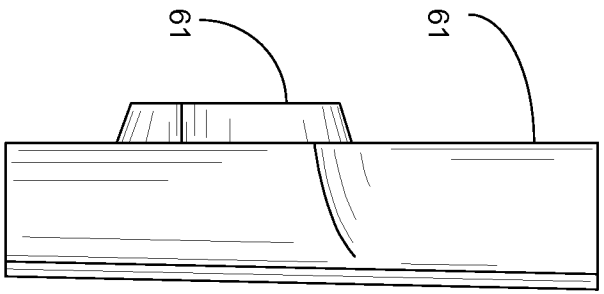
FIG. 3 is a front view of the storage compartment of the present invention removed from the toilet.

The storage compartment 30 further includes rear wall 60 that is secured to the base 10 utilizing suitable durable fasteners. It is contemplated within the scope of the present invention that the storage compartment 30 is permanently and/or releasably secured to the base 10. This allows for the securing of the storage compartment 30 to an existing conventional toilet. The rear wall 60 is manufactured from a suitable durable and formable material. As shown in particular in FIG. 3, the rear wall 60 includes a protruded portion 61. The protruded portion 61 is operable to mateably connect with the plumbing recesses that are found on conventional toilets. The rear wall 60 is manufactured in its preferred embodiment from a formable material to facilitate the molding of the protruded portion 61 in order to create a mateable shape with a plumbing recess found on the base 10. Utilizing a formable material allows the storage compartment 30 to be releasably secured to a conventional existing toilet wherein the formable material facilitates the shaping of the protruded portion 61 such that the protruded portion 61 is mateable to any plumbing recesses present on an existing toilet. While a formable material for the rear wall 60 is preferred, it is contemplated within the scope of the present invention that the rear wall 60 could be manufactured utilizing a molding process wherein the shape of the protruded portion 61 is preformed so as to mateably integrate with a plumbing recess. While a single protruded portion 61 is illustrated herein, those skilled in the art will recognize that more than one protruded portion 61 could be present so as to mateably integrate with a plurality of plumbing recesses. The formable rear wall 60 of the storage compartment 30 further facilitates the desired flush appearance of the storage compartment 30 as previously described herein and further functions to allow the interior volume 50 of the storage compartment 30 to be maximized.

The bottom 40 of the storage compartment 30 is integrally formed with the rear wall 60 and is secured to the base utilizing suitable durable fasteners. The bottom 40 is manufactured from a suitable durable material such as but not limited to plastic. The bottom 40 is manufactured such that it does not extend beyond the bottom edge 9 of the base 10. As previously discussed herein, this facilitates a design for the storage compartment 30 that is flush in appearance with the base 10.

The outer wall 35 is movably secured using fasteners 70, 75. The fasteners 70, 75 facilitate the transition of the outer wall 35 intermediate its first position and its second position. As shown in particular in FIG. 2, in its second position the outer wall 35 is extended away from the base 10 providing access to the interior volume 50. The fasteners 70, 75 are manufactured from a suitable material having a design that promotes the movement of the outer wall 35 as described herein. Those skilled in the art will recognize that the fasteners 70,75 could be manufactured from numerous different types of materials and/or existing conventional fasteners. Furthermore, it should be recognized that as few as one fasteners 70,75 could be used to promote the functionality as described and illustrated herein. Additionally, it is contemplated within the scope of the present invention that more than two fasteners 70,75 could be present.

Referring in particular to FIG. 2, the interior volume 50 of the storage compartment 30 is illustrated therein. The interior volume 50 includes a plurality of shelves 80 and a storage container 90. The shelves 80 are manufactured from a suitable durable material such as but not limited to plastic and are releasably secured to the rear wall 60 utilizing suitable durable techniques. The shelves 80 are configured to be adjustable in position and are manufactured in different lengths facilitating placement in a variety of locations within the interior volume 50. It is contemplated within the scope of the present invention any number of the shelves 80 could be present within the interior volume 50.

The interior volume 50 further includes at least one storage container 90. The storage container 90 is secured within the interior volume 50 utilizing suitable durable techniques. The storage container 90 in the illustrated embodiment is manufactured from a transparent plastic so as to facilitate the viewing of the contents stored therein. It is contemplated within the scope of the present invention that the storage container 90 could be manufactured from various different suitable materials such as but not limited to plastic. It is further contemplated within the scope of the present invention that the storage container 90 could be formed using a stretchable mesh material. Furthermore, it is contemplated within the scope of the present invention that numerous different quantities of the storage container 90 could be present within the interior volume 50 of the storage compartment 30 and wherein each of the storage containers 90 are releasably secured so as to allow a user to configure the interior volume 50 to store desired objects.

As shown in particular in FIG. 1, the storage compartment 30 further includes clips 98,99. The clips 98,99 are secured to the outer wall 35 utilizing suitable durable techniques. The clips 98,99 are manufactured from a suitable durable and resilient material such as but not limited to metal. The clips 98, 99 function to releasably secure an item having a handle such as but not limited to a conventional toilet cleaning brush. It is contemplated within the scope of the present invention any number of clips 98,99 could be present in order to releasably secure desired items to the outer wall 35 of the storage compartment 30.

While only one storage compartment 30 has been illustrated and described herein, it is contemplated within the scope of the present invention that the toilet with integrated storage 100 could have two storage compartments 30 located on opposing sides of the base 10.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A toilet including a base wherein the base includes integrated storage comprising:

a base, said base having a first end and a second end, said base having an upper edge and a lower edge, said base further including an integrated bowl, said bowl being proximate said first end of said base;

a tank, said tank being superposed said base proximate said second end of said base;

at least one storage compartment, said at least one storage compartment having a bottom, a rear wall and an outer wall defining an interior volume, said rear wall being secured adjacent to said base, said rear wall being manufactured from a formable material, said rear wall further including a protruded portion, said protruded portion operable to mate with a plumbing recess located on said base, said outer wall being hingedly attached to said base having a first position and a second position so as to facilitate access to said interior volume, said outer wall including a forward edge, said forward edge having at least a portion thereof that is arcuate in shape so as to be mateable to a portion of said bowl, said at least one storage compartment being secured to said base proximate said second end, said at least one storage compartment operable to store and receive items therein; and wherein said interior volume of said at least one storage compartment further includes at least one storage container, said at least one storage container configured to receive and store items therein.

2. The toilet as recited in claim 1, and further including a plurality of vents, said vents being present in said outer wall, said vents operable to facilitate airflow into said interior volume of said at least one storage compartment.

3. The toilet as recited in claim 2, and further including at least one fastener, said at least one fastener operable to control the movement of said outer wall intermediate said first position and said second position.

4. The toilet as recited in claim 3, and further including a plurality of clips, said plurality of clips being secured to said outer wall, said plurality of clips operable to releasably secure an item adjacent to said outer wall.

5. A storage container integrally formed with a toilet comprising:

a storage compartment, said storage compartment having a bottom, a rear wall and an outer wall defining an interior volume, said outer wall being movably attached to a base of a toilet wherein the base of the toilet has an upper edge and a lower edge and the base further includes a first side and a second side, said outer wall having a first position and a second position so as to facilitate access to said interior volume, said storage compartment being secured to the base of a toilet, said outer wall having a forward edge wherein the forward edge includes a lower portion and an upper portion, said upper portion of said forward edge being arcuate in shape so as to mateably align with a portion of a bowl portion of a toilet, said storage compartment operable to store and receive items therein; and wherein said outer wall of said storage compartment does not extend beyond said upper edge of said base and said lower edge of said base.

6. The storage container as recited in claim 5, wherein said rear wall is secured adjacent to said base, said rear wall being manufactured from a formable material, said rear wall further including a protruded portion, said protruded portion operable to mate with a plumbing recess located on said base.

7. The storage container as recited in claim 6, wherein said storage compartment further includes a plurality of storage containers, said plurality of storage containers being disposed within said interior volume of said storage compartment.

8. The storage container as recited in claim 7, and further including a plurality of vents, said vents being present in said outer wall, said vents operable to facilitate airflow into said interior volume of said storage compartment.

9. The storage container as recited in claim 8, wherein said storage compartment is secured to either said first side of said base or said second side of the base of the toilet.

10. The storage container as recited in claim 9, and further including at least one fastener, said at least one fastener operable to control the movement of said outer wall intermediate said first position and said second position.

* * * * *